United States Patent [19]

Willis

[11] Patent Number: 4,821,816

[45] Date of Patent: Apr. 18, 1989

[54] METHOD OF ASSEMBLING A MODULAR DRILLING MACHINE

[75] Inventor: Clyde A. Willis, Wichita Falls, Tex.

[73] Assignee: W-N Apache Corporation, Wichita Falls, Tex.

[21] Appl. No.: 191,584

[22] Filed: May 10, 1988

Related U.S. Application Data

[60] Division of Ser. No. 31,982, Mar. 27, 1987, Pat. No. 4,759,414, which is a continuation-in-part of Ser. No. 856,293, Apr. 25, 1986, abandoned.

[51] Int. Cl.[4] ..... E21B 7/02

[52] U.S. Cl. ..... 175/57; 166/85; 52/120

[58] Field of Search ..... 175/57, 52, 85, 170, 175/203, 220; 166/85; 173/22, 23; 52/120

[56] References Cited

U.S. PATENT DOCUMENTS

| | | | |
|---|---|---|---|
| 3,942,593 | 3/1976 | Reeve, Jr. et al. | 175/85 |
| 4,135,340 | 1/1979 | Cox et al. | 173/151 |
| 4,407,629 | 10/1983 | Willis | 175/85 |
| 4,475,607 | 10/1984 | Haney | 173/166 |
| 4,578,911 | 4/1986 | Hashimoto | 52/120 |

FOREIGN PATENT DOCUMENTS

| | | | |
|---|---|---|---|
| 2139269 | 11/1984 | United Kingdom | 175/85 |

*Primary Examiner*—Jerome W. Massie

*Assistant Examiner*—Terry Lee Melius

*Attorney, Agent, or Firm*—Willian Brinks Olds Hofer Gilson & Lione Ltd.

[57] ABSTRACT

A drilling machine includes a drilling substructure skid which defines two spaced parallel skid runners and a platform. The platform supports a draw works mounted on a draw works skid, and a pipe boom is mounted on a pipe boom skid sized to fit between the skid runners of the drilling substructure skid. The drilling substructure skid supports four legs which in turn support a drilling platform on which is mounted a lower mast section. The legs are pivotably mounted both at the platform and at the driling substructure skid and a pair of platform cylinders are provided to raise and lower the drilling platform. A pair of rigid, fixed length struts extend diagonally between the platform and the substructure skid away from the platform such that the struts do not extend under the platform and obstruct access to the region under the platform. Preferably, the pipe boom skid mounts a pipe boom as well as a boom linkage, a motor, and a hydraulic pump adapted to power the pipe boom linkage. Preferably the substructure skid is formed in upper and lower skid portions, and leveling rams are provided to level the upper skid portion with respect to the lower skid portion. Mechanical position locks hold the upper skid in relative position over the lower skid.

2 Claims, 8 Drawing Sheets

FIG. 1
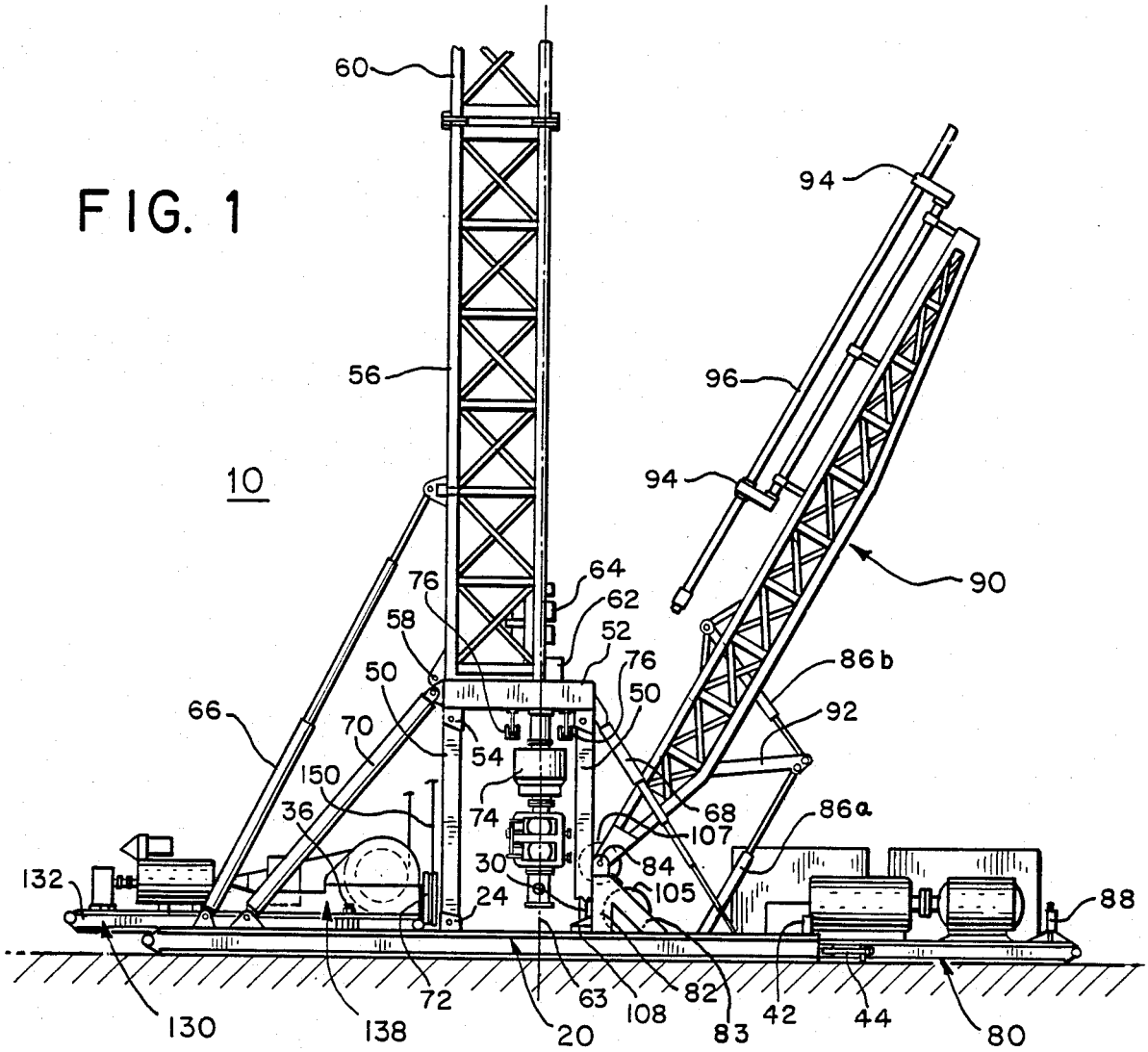
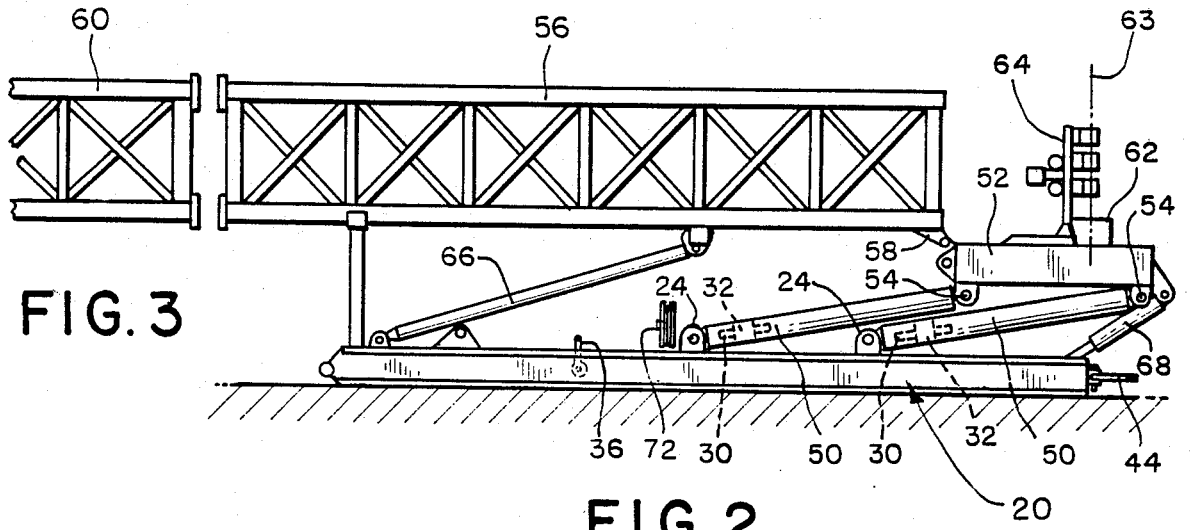
FIG. 3
FIG. 2

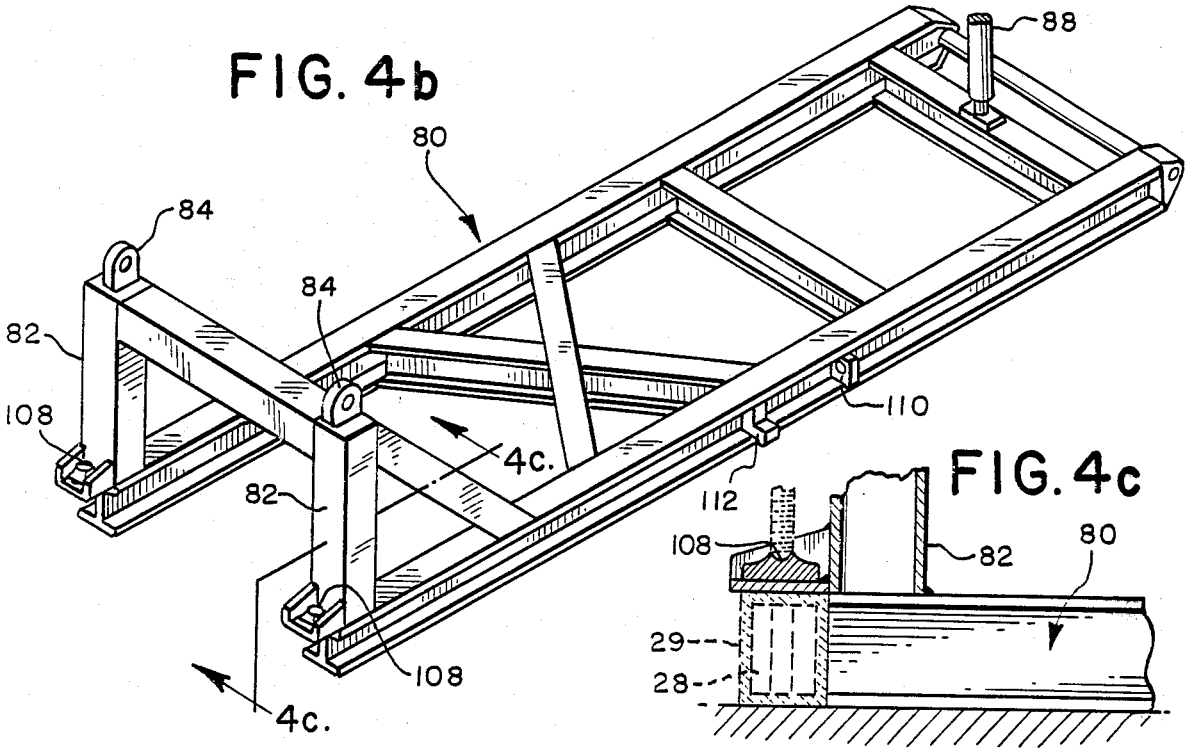
FIG. 4b
FIG. 4c
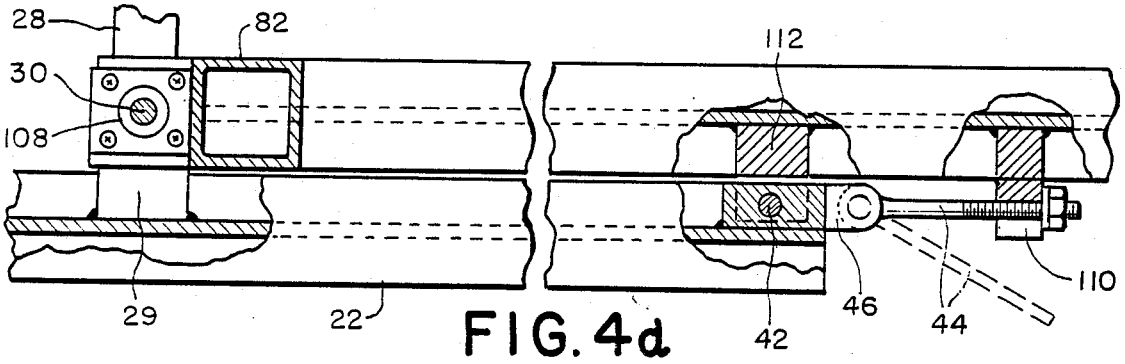
FIG. 4d
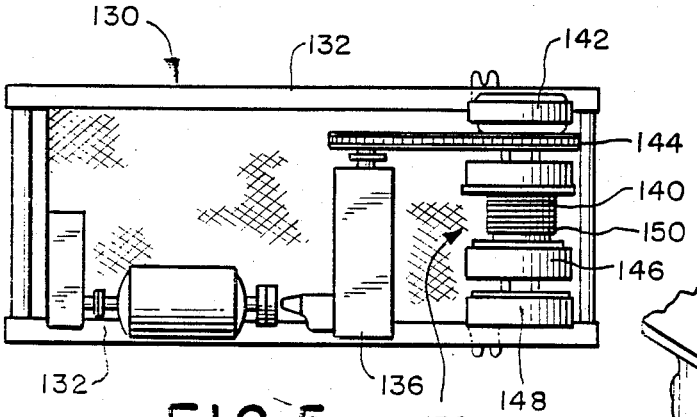
FIG. 5a
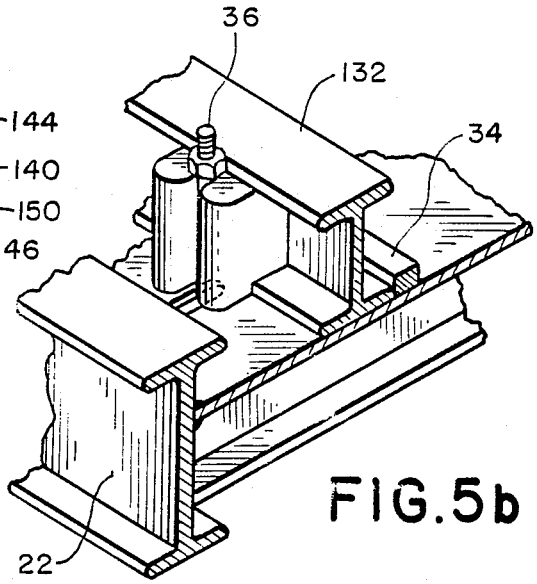
FIG. 5b

METHOD OF ASSEMBLING A MODULAR DRILLING MACHINE

CROSS REFERENCE TO RELATED APPLICATION

This is a division of application Ser. No. 031,982 filed Mar. 27, 1987, now U.S. Pat. No. 4,759,414 and application Ser. No. 031,982 is a continuation-in-part of copending application Ser. No. 06/856,293, filed Apr. 25, 1986 now abandoned.

BACKGROUND OF THE INVENTION

The present invention relates to earth drilling machines in general, and in particular to modular earth drilling machines which can readily be assembled and disassembled to enhance mobility of the drilling machine. As used herein, the term "earth drilling machine" is intended to cover the entire range of machines for forming a borehole in an earth formation, including oil well drilling machines, water well drilling machines, and the like.

Portability is an important consideration in modern earth drilling machines. When excessive times are required for rigging and derigging a machine, productivity of the drilling machine is reduced and operating costs are increased unnecessarily. One class of modern drilling machines is intended to be transported over the highway on suitable trucks. With such drilling machines it is particularly important that the drilling machine be readily divided into a small number of modules, each of which is well suited for highway transportation.

To this end, some drilling machines have in the past included skid-mounted draw works. Such skid-mounted draw works are readily moved onto a truck for highway transport and then off of the truck at the drilling site for use with the drilling machine. In addition, in order to improve mobility of drilling machines, in the past one type of drilling machine has employed a drilling platform which is pivotably connected to a ground support structure by means of legs which are pivoted at top and bottom. Means such as winches have been provided to lift the drilling platform into an operating position in which the legs are vertically positioned, and to lower the drilling platform to reduce the height of the platform and thereby improve the mobility of the drilling machine.

The present invention is directed to an improved, modular, earth drilling machine which further reduces the time required to rig and derig the drilling machine at the drilling site, and which is well adapted for transport of the modules of the drilling machine by truck.

SUMMARY OF THE INVENTION

According to a first feature of this invention, an earth drilling machine is provided which comprises a substructure skid which comprises a lower skid portion, an upper skid portion movably mounted to the upper skid portion, and means for leveling the upper skid portion with respect to the lower skid portion such that the upper skid portion can be leveled after the lower skid portion has been located in place. A drilling substructure comprises a platform and a plurality of legs, each pivotably mounted at one end to the platform and at the other end to the upper skid portion of the substructure skid. This platform is movable between an upper position and a lower position, and means are mounted on the substructure skid for moving the platform between the upper and lower positions. A pipe boom skid is rigidly secured in position to the upper skid portion in order to align the pipe boom skid with the drilling substructure.

According to a second feature of this invention, a drilling machine is provided with a modular pipe boom assembly which comprises a pipe boom skid comprising a pair of spaced boom supports at one end, and a reaction support at an intermediate point. A pipe handling boom, hereinafter referred to as a pipe boom, is pivotably mounted to the boom supports for rotation about a pivot axis, and hydraulic cylinder means are coupled between the reaction support and the pipe boom for raising and lowering the pipe boom about the pivot axis. Preferably, means are mounted directly to the pipe boom skid for powering the hydraulic cylinder means such that the skid, the pipe boom, the hydraulic cylinder means and the powering means together form a modular unit well adapted to be transported as a single unit. In use, means are provided for securing the pipe boom skid rigidly in position adjacent to a drilling substructure to position the pipe boom properly in alignment with the drilling substructure.

Preferably, the pipe boom skid and the drilling substructure skid are used in combination with a draw works skid which mounts a draw works comprising a winch and means for driving the winch. When this approach is taken, the entire drilling machine can be moved as separate modules, each as a separate truck load: the drilling substructure skid including the drilling substructure and a lower portion or all of the mast, the upper portion of the mast including the tophead drive swivel, if not transported with the substructure skid, the draw works skid including the draw works, and the pipe boom skid including the pipe boom and preferably the pump and motor for raising and lowering the pipe boom. By dividing the drilling machine into modules in this manner, a simple, reliable drilling machine is provided which can readily be transported by highway, and which can be rigged and derigged in a minimum of time, thereby increasing the operating efficiency of the drilling machine.

The invention itself, together with further objects and attendant advantages, will best be understood by reference to the following detailed description, taken in conjunction with the accompanying drawings.

BRIEF DESCRIPTION OF THE DRAWINGS

FIG. 1 is a side elevation of an earth drilling machine which incorporates a first presently preferred embodiment of this invention, in which the drilling machine is in the operative position.

FIG. 2 is a side elevation of the substructure skid of FIG. 1, lowered to a transport position.

FIG. 3 is a side elevation of a portion of the upper mast segment of FIG. 1.

FIG. 4*b* is a perspective of the pipe boom skid of FIG. 4, shown with various elements removed for clarity.

FIG. 4*c* is a section taken along line 4*c*—4*c* of FIG. 4*b*.

FIG. 4*d* is a plan partially in section of parts of the pipe boom skid of FIG. 4 and the substructure skid of FIG. 2.

FIG. 5*a* is a plan of the draw works skid of FIG. 5.

FIG. 5*b* is a fragmentary perspective of parts of the draw works skid of FIG. 5 and the substructure skid of FIG. 2.

DETAILED DESCRIPTION OF THE PRESENTLY PREFERRED EMBODIMENT

Figure 2B:
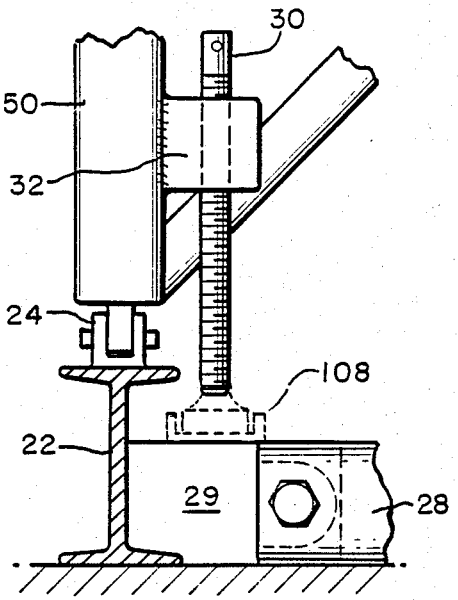
FIG. 2*b* is a section taken along line 2*b*—2*b* of FIG. 2*a*.

Turning now to the drawings, FIGS. 1–5*b* relate to a first preferred embodiment and FIGS. 6–14 relate to a second preferred embodiment. These two embodiments will be described in the following sections.

The First Preferred Embodiment

FIG. 1 shows a side elevation of a first preferred embodiment 10 of the drilling machine of this invention. This drilling machine 10 includes a substructure skid 20, a pipe boom skid 80, and a draw works skid 130, which will be described in the following paragraphs.

Figure 2D:
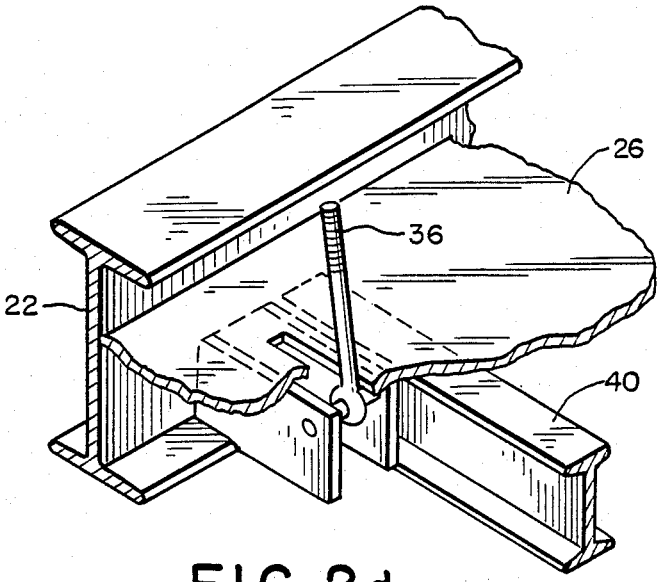
FIG. 2*d* is a fragmentary perspective of the elements shown in FIG. 2*c*.
Figure 2C:
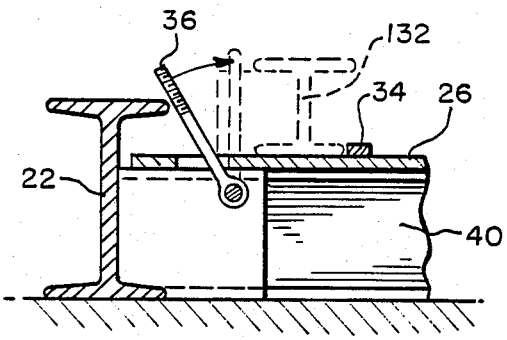
FIG. 2*c* is a section taken along line 2*c*—2*c* of FIG. 2*a*.
Figure 2E:
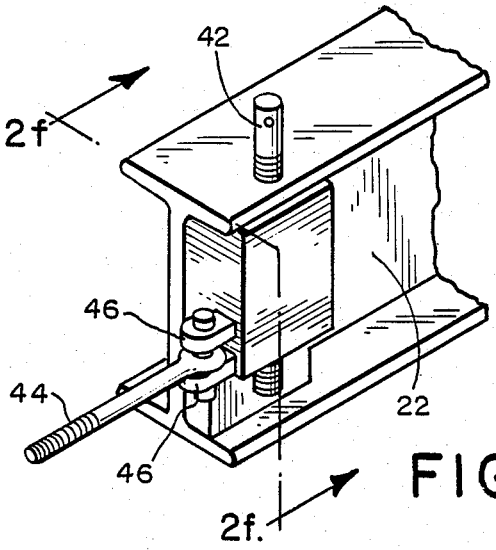
FIG. 2*e* is a fragmentary perspective of parts of the substructure skid of FIG. 1.
Figure 2F:
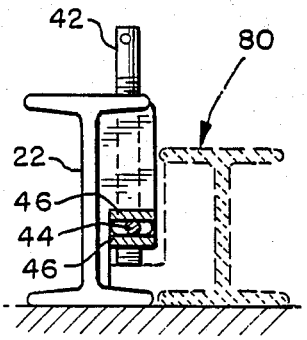
FIG. 2*f* is a section taken along line 2*f*—2*f* of FIG. 2*e*.
Figure 2A:
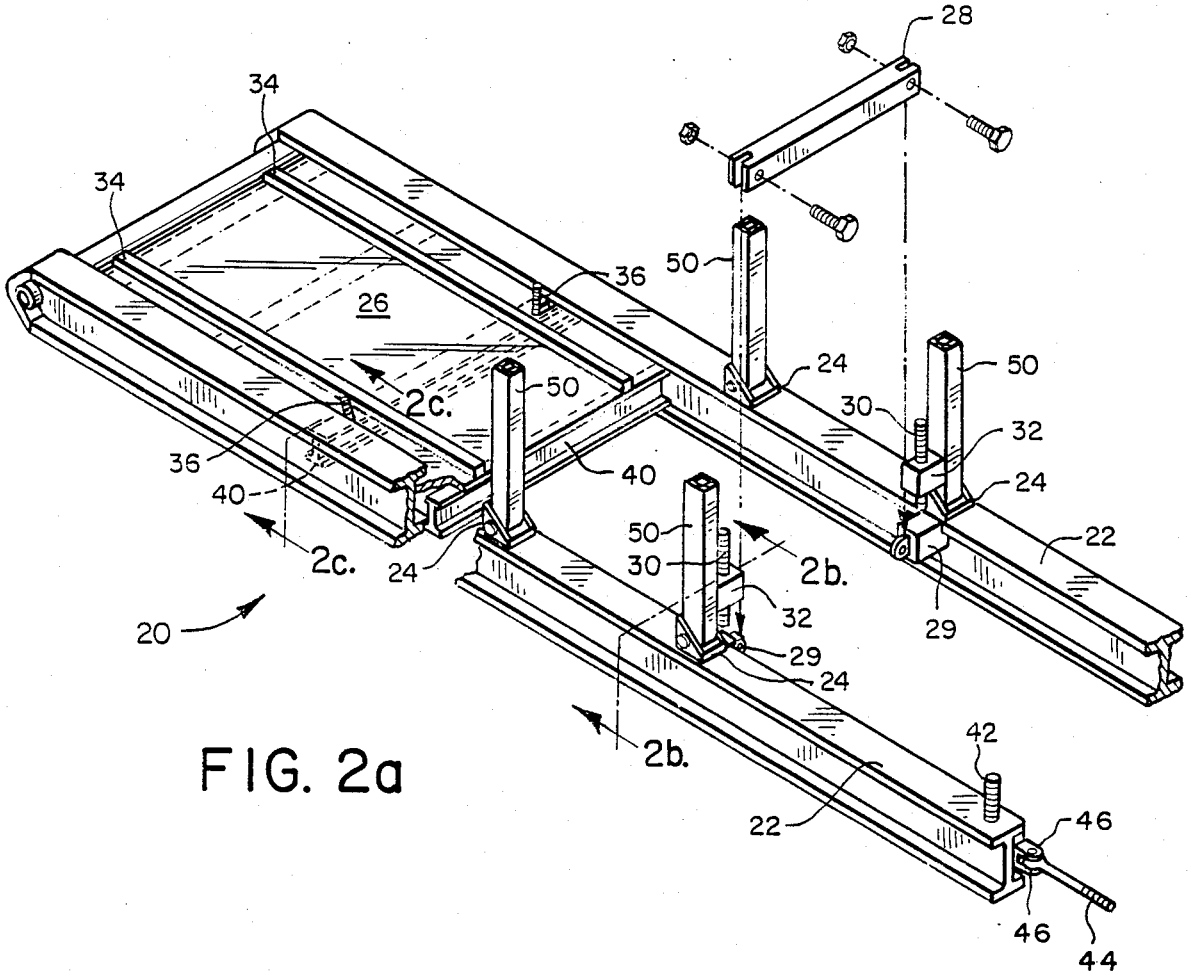
FIG. 2*a* is an exploded perspective in partial cutaway of parts of the substructure skid of FIG. 1.

The substructure skid 20 is best shown in FIGS. 2–2*f* and is a generally planar structure which defines a pair of spaced parallel skid runners 22 at one end and a flat platform 26 at the other (FIG. 2*a*). In general, the skid runners 22 and the platform 26 should be formed of I-beams or H-beams sized to provide proper support for the particular drilling machine and to spread the load widely over the support surface. Each of the skid runners 22 serves to mount a spaced pair of lower pivot brackets 24. The arms 22 are connected adjacent the pair of lower pivot brackets 24 spaced from the platform 26 by a removable cross-member 28 which is removably secured at each end to a cross-member support 29 (FIG. 2*a*). This removable cross-member 28 provides extra rigidity in the region of the lower pivot brackets 24. However, it can be removed when necessary to remove the substructure skid 20 from a well which has been drilled with the drilling machine 10.

Four tubular legs 50 are provided, each pivotably mounted to a respective one of the lower pivot brackets 24. The two legs 50 nearest the removable cross-member 28 support respective jack screw brackets 32 which in turn threadedly support respective jack screws 30 (FIGS. 2*a* and 2*b*). By rotating the jack screws 30 in the jack screw brackets 32, the jack screws 30 can be raised and lowered as described below.

The platform 26 has mounted on it a pair of locator blocks 34, as best shown in FIG. 2*a*. These locator blocks 34 are positioned to align the draw works skid 130 properly on the platform 26. A plurality of tiedown bolts 36 are secured to the deck 26 so as to clamp the draw works skid 130 securely in place on the platform 26 by means of respective tiedown brackets 38. The illustrated tiedown bolts 36 are mounted to a cross-member 40 which extends across the width of the deck 26 (FIGS. 2*c* and 2*d*). The total number of tiedown bolts 36 should be chosen to secure the draw works skid 130 securely in place.

As shown in FIGS. 2*e* and 2*f*, each of the skid runners 22 supports an additional jack screw 42 oriented vertically. In addition, the outer end of each of the skid runners 22 pivotably supports a respective latch bolt 44. The latch bolts 44 are mounted between respective latch bolt flanges 46 so as to pivot in the horizontal plane.

As shown in FIGS. 1 and 2, the legs 50 support a platform 52 by means of upper pivot brackets 54 which are rigidly secured to the platform 52 and pivotably secured to the legs 50. The platform 52 in turn supports a lower mast section 56 which is pivotably mounted to the platform 52 by a pair of mast hinges 58 such that the lower mast section 56 is rotatable about a horizontal pivot axis. The lower mast section 56 extends vertically in the operating position shown in FIG. 1, and supports at its upper end an upper mast section 60. The upper mast section 60 is readily removable from the lower mast section 56 for separate transport (FIG. 3). The upper mast section 60 includes a crown block (not shown) at its upper end which supports cables that in turn support a power swivel (not shown) suitable for use in tophead drive drilling machines.

As shown in FIGS. 1 and 2, a slip bowl 62 is mounted to the platform 52, and the slip bowl 62 is centered on the drill string centerline 63. Remote controlled wrenches 64 which include a spinner are also mounted to the platform 52 to be movable into alignment with the drill string centerline 63. These wrenches 64 are used to make up and break out threaded connections between adjacent tubulars.

A pair of mast erecting hydraulic cylinders 66 are mounted between the substructure skid 20 and the lower mast section 56 to raise and lower the mast, or alternatively the lower mast section 56, between the operating position shown in FIG. 1, and the transport position shown in FIG. 2. In addition, two platform raising hydraulic cylinders 68 are mounted between the platform 52 and the skid runners 22. These platform raising cylinders 68 are telescoping hydraulic cylinders used to raise and lower the platform 52 between the operating position shown in FIG. 1 and the transport position shown in FIG. 2. After the platform 52 has been raised to the operating position of FIG. 1, a pair of fixed length struts 70 are mounted between the platform 52 and the substructure skid 20 to brace and hold the platform 52 in the operating position. A deadline anchor 72 is mounted to the substructure skid 20 to secure the deadline of the cable used to raise and lower the tophead drive swivel (not shown).

It is important to note that the platform 52 is effectively stabilized by the legs 50, the struts 70, and the cylinders 68, yet none of the struts 70 and the cylinders 68 extends beneath the platform 52. Thus, the region between the legs 50 is left free of obstructions. This is important in this embodiment because a blowout preventer 74 is mounted on a trolley 76 which extends crosswise, across the width of the platform 52. Because the struts 70 and the cylinders 68 do not extend under the platform 52, the blowout preventer 74 can be moved to the side, away from the drilling centerline, without obstruction from the struts 70.

Figure 4A:
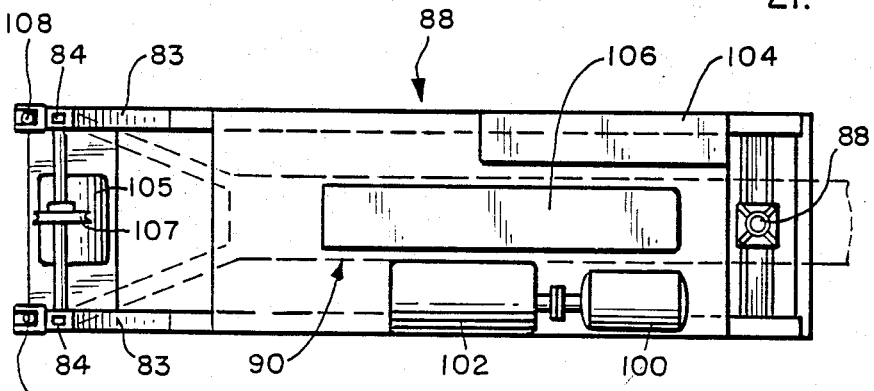
FIG. 4*a* is a plan of the pipe boom skid of FIG. 4, shown with the pipe boom removed for clarity.
Figure 4:
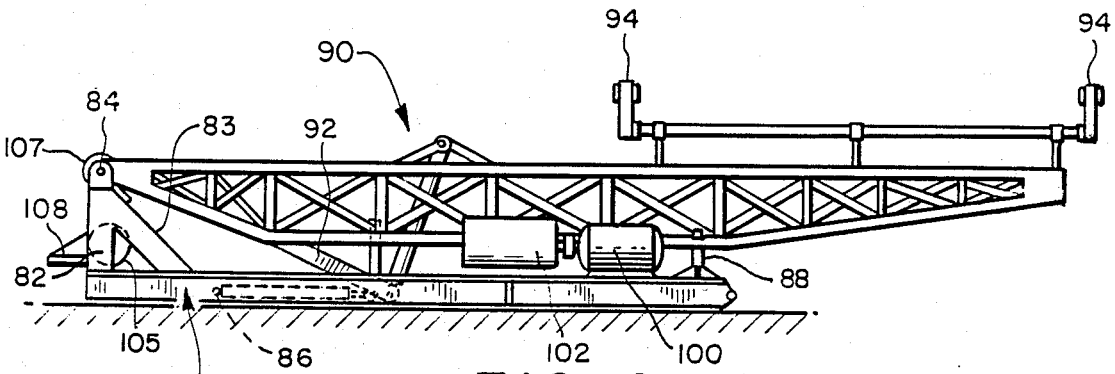
FIG. 4 is a side elevation of the pipe boom skid of FIG. 1.

The pipe boom skid 80 is best shown in FIGS. 4–4*d* and is dimensioned to fit between the skid runners 22 of the substructure skid 20. This pipe boom skid 80 is a generally planar structure which defines at one end a pair of uprights 82, each of which is supported by a respective diagonal brace 83 and supports at its upper end a respective boom pivot bracket 84 (FIGS. 4 and 4*b*). The pipe boom skid 80 also includes a cylinder or reaction support 86 and a pipe boom stop assembly 88.

A pipe boom 90 is pivotably mounted to the boom pivot brackets 84 so as to pivot about a horizontal axis. The position of the pipe boom 90 with respect to the pipe boom skid 80 is determined by a boom linkage 92 which includes a pair of hydraulic cylinders 86*a*, 86*b* having identical inside diameters and pivotably mounted to the outer end of a rigid link 91. This boom linkage 92 can be used to raise and lower the pipe boom 90 between a lower position, in which the boom is substantially parallel with the ground, and a raised position, in which the boom 90 is parallel to the drill string centerline 63. A pair of rotatable boom clamps 94 are secured to the pipe boom 90 so as to clamp a tubular 96. When the pipe boom 90 is in the lowered position, the tubular 96 can readily be moved into or out of the boom clamps 94. When the pipe boom 90 is in the raised position, the tubular 96 is aligned with the drill string centerline 63 and can readily be incorporated into or removed from the drill string. Copending U.S. application Ser. No. 06/747,351 describes the boom linkage 92 in greater detail. U.S. Pat. No. 4,407,629 describes one suitable pipe boom 90 which can be used with this invention, and U.S. Pat. No. 4,475,607 describes a suitable boom clamp 94 for use with this invention.

Preferably, the pipe boom skid 80 mounts the power source used to drive the boom linkage 92. In this embodiment, this power source includes a 175 horsepower electric motor 100 which drives a hydraulic pump 102 that pumps hydraulic fluid between a reservoir 104 and the hydraulic cylinders 86*a*, 86*b* (FIG. 4*a*). Preferably, a suitable hydraulic fluid cooler 106 is provided. By mounting the power source for the boom linkage directly on the pipe boom skid 80, the time required to rig up and rig down is markedly reduced. By mounting the pump 102 directly on the pipe boom skid 80, the need to break and make up hydraulic lines when the drilling machine is moved is eliminated, thereby eliminating a major source of contamination of the hydraulic system.

The pipe boom skid 80 also includes fixtures which cooperate with the jack screws 30, the jackscrews 42 and the latch bolts 44 to secure the pipe boom skid 80 in position with respect to the substructure skid 20. These fixtures include a pair of jackscrew sockets 108 which are mounted to the uprights 82 so as to overlie closely the cross-member supports 29 when the pipe boom skid 80 is positioned properly (FIGS. 4*a* and 4*c*). The jackscrews 30 are then tightened down into the jackscrew sockets 108 to lock the pipe boom skid 80 in position in all three dimensions. The pipe boom skid 80 additionally includes a pair of latch bolt flanges 110, each positioned to receive a respective one of the latch bolts 44, as well as an additional pair of jackscrew sockets 112, each positioned to receive a respective one of the jackscrews 42 (FIG. 4*d*).

In this embodiment a winch 105 is mounted to the pipe boom skid 80, as shown in FIG. 4*a*. This winch controls a cable which passes over a sheave 107 and is used in setting up the drilling machine, as described below. The winch 105 may be electrically powered or it may be powered by the hydraulic pump 102.

Figure 5:
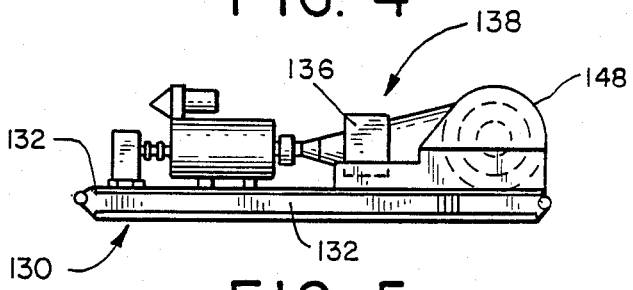
FIG. 5 is a side elevation of the draw works skid of FIG. 1.

As shown in FIGS. 5–5*b*, the draw works skid 130 includes a deck of steel plate which is bounded at each lateral side by a respective I-beam 132 and is suitably braced by appropriate cross members. Mounted on the deck are a suitable electric motor, such as a General Electric Model 752, 1,000 horsepower motor, which drives a draw works 138 via a four-speed gear box 136. The draw works 138 includes a drum 140 which is connected to the four-speed gear box 136 by a chain drive 144 and an air tube disc clutch 142. A band-type brake 146 and a disc-type auxiliary brake 148 are provided to control rotation of the drum 140. Simply by way of example, in this embodiment the disc clutch 142 is a three-plate clutch 30 inches in diameter, the drum 140 is 28 inches in diameter, the band brake is 46 inches in diameter and 10¼ inches in width, and the disc-type auxiliary brake 148 includes multiple 30-inch diameter discs. A cable 150 is removably mounted to the drum 140 and travels from the drum 140 to the crown block (not shown) and via the crown block to the tophead drive (not shown). This cable 150 terminates at the deadline anchor 72 described above.

Having described the structure, the operation of the earth drilling machine 10 can now be described. Typically, this earth drilling machine 10 is transported as four separate modules, each as a separate truck load. The first module is the substructure skid 20 in which the lower mast section 56 and the platform 52 have been lowered by the mast erecting cylinders 66 and the platform raising cylinders 68, respectively, to the position shown in FIG. 2. The second module is the upper mast section 60 including the tophead drive swivel and the cable 150. The third module is the pipe boom skid 80 including the pipe boom 90 and the means for raising the lowering the pipe boom 90. The fourth module is the draw works skid 130.

The first step in rigging the drilling machine 10 is to position the substructure skid 20 properly with respect to the desired drilling position. Then the upper mast section 60 is bolted to the lower mast section 56, and the platform raising cylinders 68 are used to raise the platform 52 from the position shown in FIG. 2 to the position shown in FIG. 1. The winch 105 can be used to lift the platform 52 to assist the cylinders 68 during the initial stages of the raising operation. Then the struts 70 are mounted to lock the platform 52 in the raised operative position.

Then, pipe boom skid 80 is positioned between the skid runners 22 of the substructure skid 20 until the latch bolts 44 can be secured to the latch bolt flanges 110. The winch 105 can be used to pull the pipe boom skid 80 into position, thereby eliminating the need for auxilliary positioning equipment. Then the latch bolts 44 are used to draw the pipe boom skid 80 toward the removable cross-member 28 until the pipe boom skid 80 abuts the cross-member supports 29. At this point the jackscrews 30,42 are lowered to engage the respective jackscrew sockets 108,112, thereby locking the pipe boom skid 80 in place. The mast erecting cylinders 66 are then used to raise the mast sections 56,60 from the position shown in FIG. 2 to the position shown in FIG. 1, and the deadline of the cable 150 is secured to the deadline anchor 72.

The draw works skid 130 is then positioned on the platform 26, located by the locator blocks 34, and the tie-down bolts 36 are used to lock the draw works skid 130 securely in place on the platform 26. The free end of the cable 150 is then secured to the drum 140. Derigging is accomplished by reversing the procedure set out above. winch 105 can be used, in conjunction with a snatch block (not shown) hung from a hook under drilling platform 52, to pull draw works skid into position.

From the foregoing, it should be apparent that an improved modular drilling machine has been described which can readily be rigged and derigged with a minimum of manpower and time and which contributes importantly to the operating efficiency of the drilling machine. All of this is accomplished without unnecessary increase to the capital cost of the drilling machine.

The Second Preferred Embodiment

FIGS. 6–14 provide various views of the second preferred embodiment 200 of the drilling machine of this invention. This second preferred embodiment 200 is similar in many respects to the first preferred embodiment 10 described above. The following discussion will focus on the differences between the two embodiments, and the foregoing detailed description should be referenced for a discussion of the common features between the two embodiments.

The second preferred embodiment 200 includes a substructure skid 220, a pipe boom skid 310, and a draw works skid 330. The principal differences between the two embodiments relate to the substructure skid 220. The draw works skid 330 is identical to the draw works skid 130 described above, and the pipe boom skid 310 is identical to the pipe boom skid 80 described above with the exceptions described below relating to the means for locating the pipe boom skid 310 with respect to the substructure skid 220. The following discussion will first describe the substructure skid 220 in detail, and will then describe the manner in which the second preferred embodiment 200 is rigged and derigged.

Figure 6:
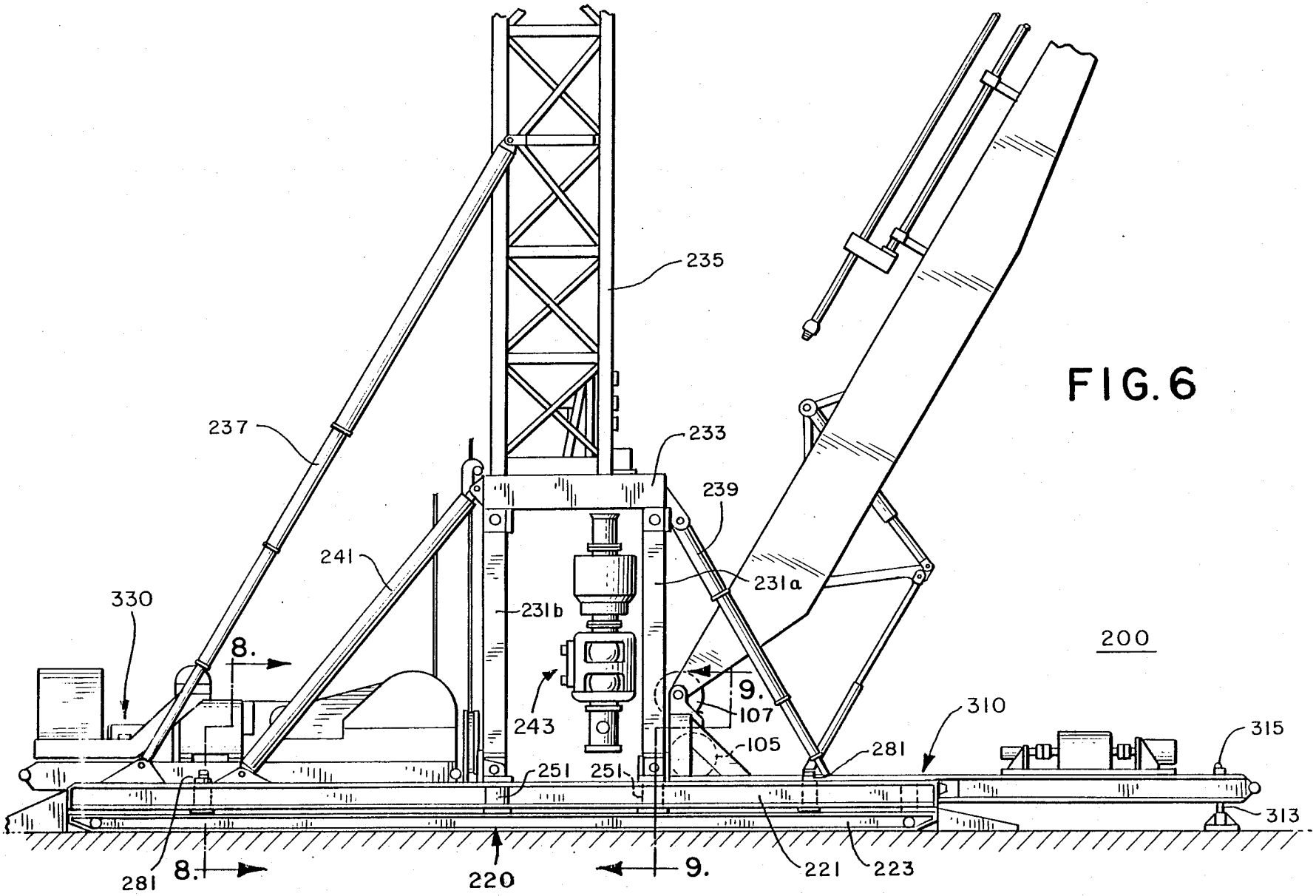
FIG. 6 is a partial side elevation of an earth drilling machine which incorporates a second preferred embodiment of this invention, in which the drilling machine is in the operative position.
Figure 7:
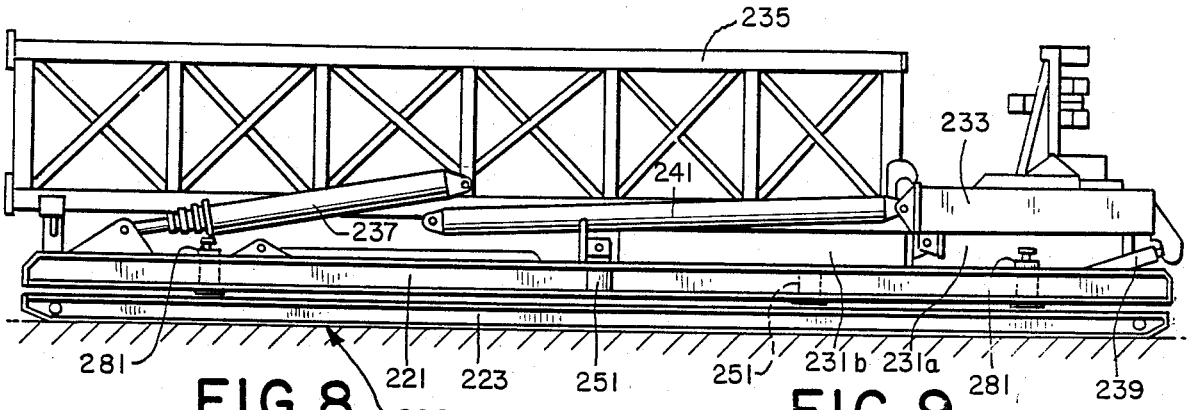
FIG. 7 is a side elevation of the substructure skid of FIG. 6, lowered to the transport position.

FIG. 6 shows the second preferred embodiment 200 in the rigged position, ready to begin drilling operations. As shown in FIG. 6, the substructure skid 220 includes an upper skid portion 221 which overlies a lower skid portion 223. The upper skid portion 221 supports both the pipe boom skid 310 and the draw works skid 330, as well as the drilling substructure made of the platform 233 and the legs **231*a* and 231*b*. As explained in detail below, the upper skid portion 221 can be leveled with respect to the lower skid portion 223** to facilitate setup of the drilling machine.

As best shown in FIGS. 10–14, both the upper skid portion 221 and the lower skid portion 223 define spaced parallel skid runners 225. The skid runners 225 of the upper skid portion 221 are each formed of three parallel I beams **227*a*, 227*b*, and 227*c* which are rigidly secured together. The I-beam 227*c* is smaller than the I-beams 227*a* and 227*b*, and thus forms a ledge or step positioned to receive the pipe boom skid 310. The upper skid portion 221 also defines a platform shaped to receive and locate the draw works skid 330**.

In a manner similar to that described above in conjunction with the first preferred embodiment, a lower mast section 235 is pivotably mounted to the platform 223 (FIG. 6). A pair of mast erecting cylinders 237 extend between the upper skid portion 221 and the lower mast section 235, and a pair of platform raising cylinders 239 extend between the upper skid portion 221 and the platform 233. A pair of rigid, fixed length struts 241 are mounted between the platform 233 and the upper skid portion 221 to secure the platform 233 rigidly in position. A blow-out preventer 243 is positioned as described above under the platform 233.

As best shown in FIGS. 10–14, the skid runners 225 of the upper skid portion 221 serve to mount a plurality of tapered locating pins 245. Similarly, the pipe boom skid 310 supports a plurality of locating pin sockets 311, each positioned to engage a respective one of the locating pins 245. The locating pins 245 and the locating pin sockets 311 are positioned such that the pipe boom skid 310 can be moved parallel to the skid runners 225 to engage the locating pins 245 with the respective locating pin sockets 311. A pair of tie bolts 247 are provided between the upper skid portion 221 and the pipe boom skid 310 to lock the pipe boom skid 310 securely in position, with the locating pins 245 captured in the respective locating pin sockets 311. Once the tie bolts 247 are tightened in place, the pipe boom skid 310 is rigidly secured to the upper skid portion 221. A pair of diagonal braces 249 are mounted between the skid runners 225 of the upper skid portion 221 to maintain the skid runners 225 in parallel alignment.

Because the pipe boom skid 310 is supported on the upper skid portion 221, the end of the pipe boom skid 310 farthest from the substructure skid 221 is preferably supported above ground level by a screwjack 313. As shown in FIG. 6, the screwjack 313 is preferably positioned directly under the boom stop 315 which determines the rest position of the pipe boom.

Figure 9:
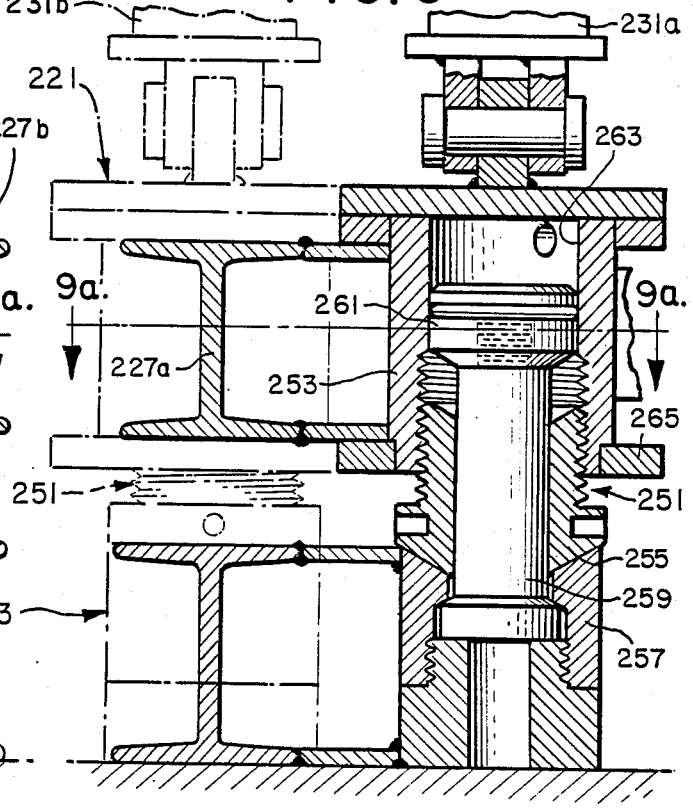
FIG. 9 is a partial section taken along line 9—9 of FIG. 6.

As shown in FIG. 9, the front legs **231*a* are positioned over the I-beams 227*b* and the rear legs 231*b* are positioned over the I-beams 227*a*, such that the front and rear legs 231*a*, 231*b* are laterally offset with respect to one another. This lateral offset allows the legs 231*a*, 231*b* to move to the retracted position shown in FIG. 7, thereby minimizing the height of the substructure skid 220** when in the collapsed position.

Figure 9A:
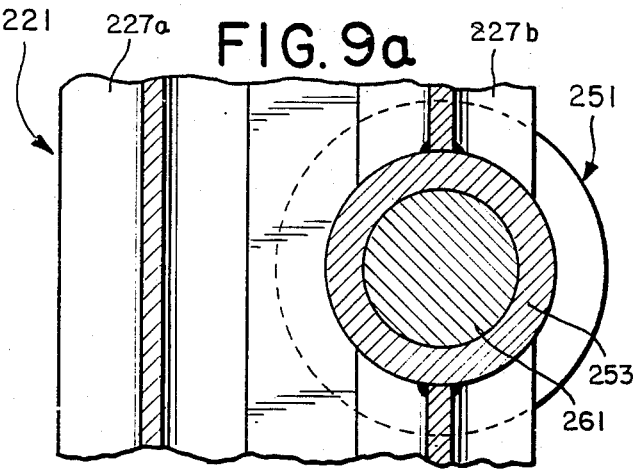
FIG. 9*a* is a partial section taken along line 9*a*—9*a* of FIG. 9.
Figure 10:
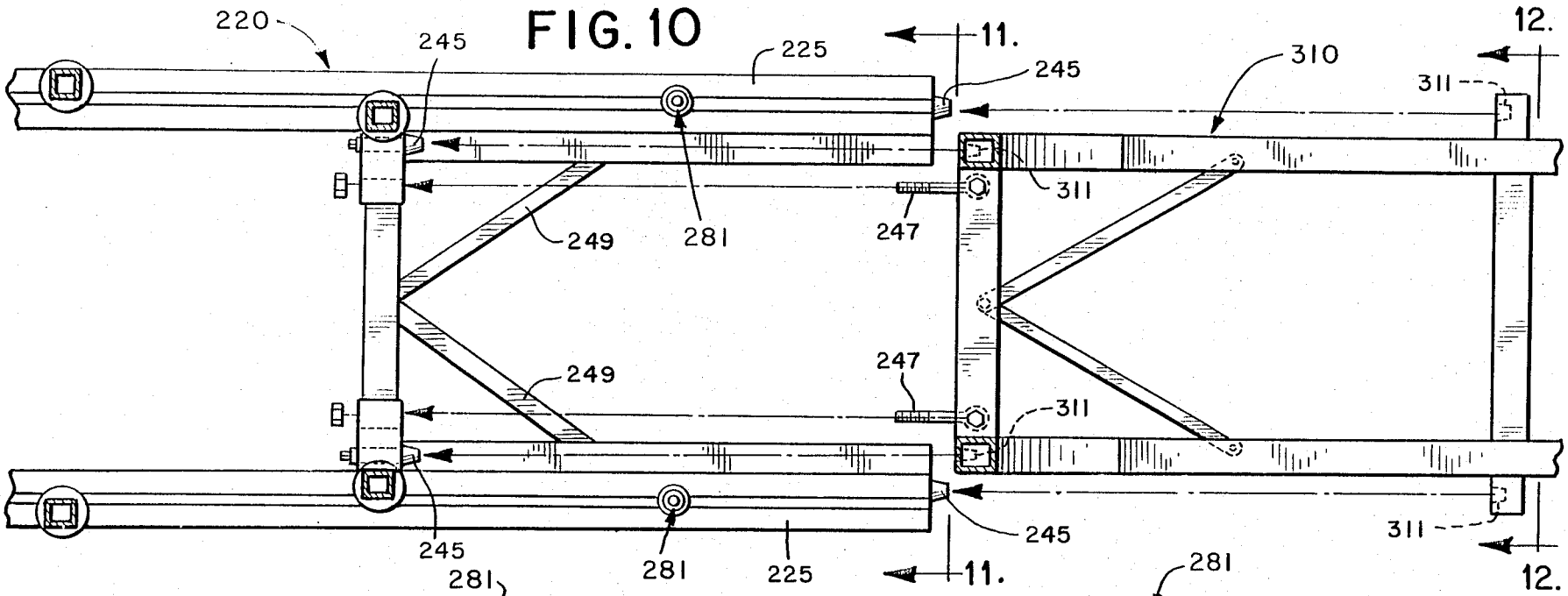
FIG. 10 is a fragmentary plan of portions of the substructure skid and the pipe boom skid of FIG. 6.
Figure 11:
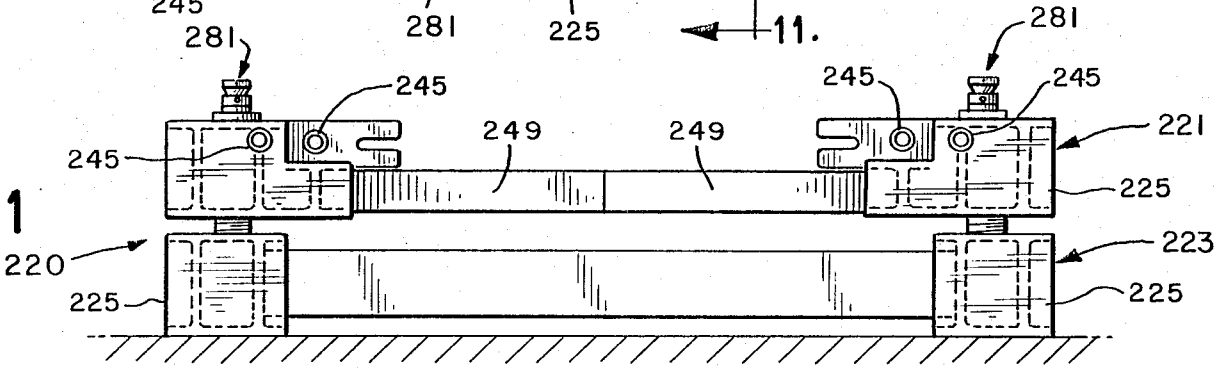
FIG. 11 is a section taken along line 11—11 of FIG. 10.
Figure 12:
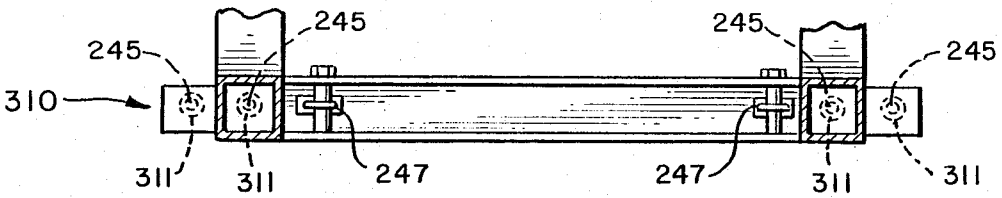
FIG. 12 is a section taken along line 12—12 of FIG. 10.
Figure 13:
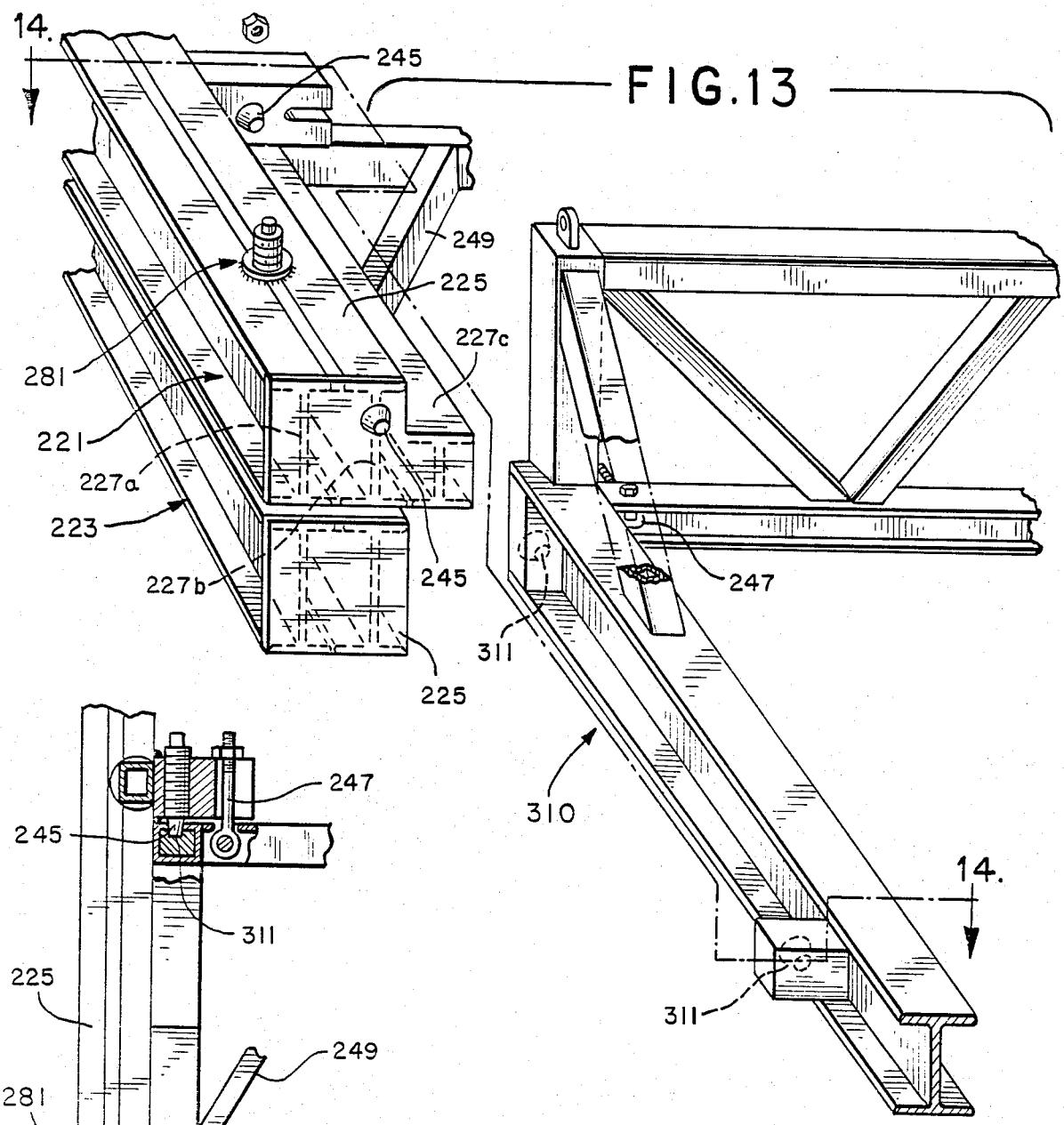
FIG. 13 is a partial perspective of the skids of FIG. 10.
Figure 14:
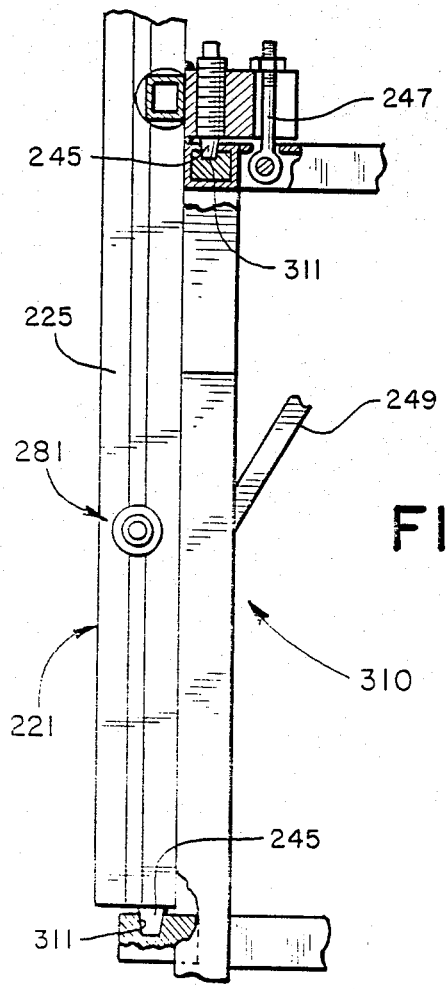
FIG. 14 is a partial section taken along line 14—14 of FIG. 13.

As pointed out above, one important feature of the substructure skid 220 is that means are provided for leveling the upper skid portion 221 independently of the lower skid portion 223. This leveling function is performed by four leveling rams 251, each positioned under a respective one of the legs **231*a*, 231*b*. FIGS. 9 and 9*a* show cross-sectional views taken through one of the leveling rams 251. As shown in FIG. 9, each of the leveling rams 251 includes a replaceable threaded sleeve 253** which is locked in position in the upper skid portion 221 by a sleeve retainer 265. The threaded sleeve 253 is keyed to prevent rotation of the threaded sleeve 253 with respect to the upper skid portion 221. A downwardly facing nut 255 is threadedly engaged with the threaded sleeve 253; preferably, the thread engagement when the nut 255 is fully extended should be at least six inches and the pitch diameter of the thread should be at least about nine inches. Preferably, one inch diameter holes are provided in the exposed shoulder of the nut 255 to allow a wrench to engage the nut 255 for adjustment purposes.

Each of the leveling rams 251 includes a load bearing element 257 which is fixedly secured in place to the lower skid portion 223 in alignment with the respective threaded sleeve 253. The nut 255 is shaped to bear against the load bearing element 257, as is the lower end of a piston rod 259. This piston rod 259 defines at its upper end a piston 261 which slides in a cylinder 263 defined by the threaded sleeve 253. The cylinder 263 should be sealed in the conventional manner, including, if necessary, sliding seals on the piston rod 261. Preferably, the outside diameter of the piston rod 259 is at least four inches.

From the foregoing description, it should be apparent that the cylinder 263 and the piston 261 cooperate to form means for raising the upper skid portion 221 with respect to the lower skid portion 223. This is done by introducing hydraulic fluid under pressure into the cylinders 263. Preferably hydraulic fluid is valved into the hydraulic cylinders 263 separately such that the leveling rams 251 can be used to adjust the tilt angle of the upper skid portion 221 with respect to the lower skid portion 223. Once the piston 261 has been positioned at the desired location inside the cylinder 263, the nut 255 can then be lowered to serve as means for mechanically locking the position of the upper skid portion 221 with respect to the lower skid portion 223.

Figure 8:
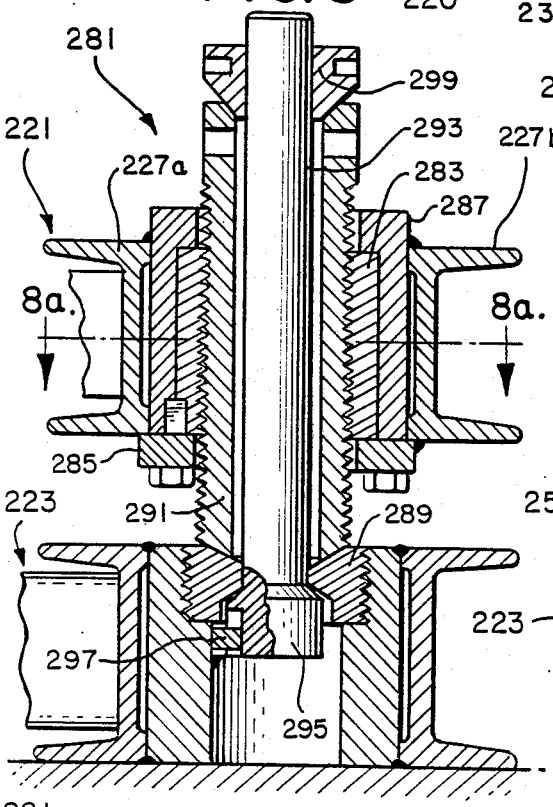
FIG. 8 is a partial section taken along line 8—8 of FIG. 6.
Figure 8A:
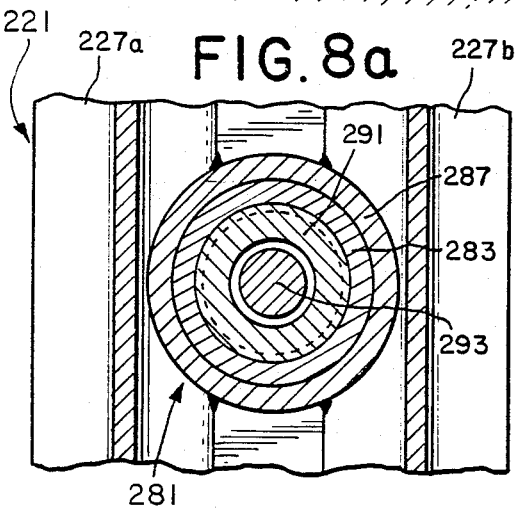
FIG. 8*a* is a partial section taken along line 8*a*—8*a* of FIG. 8.

As best shown in FIGS. 6, 8 and 8*a*, the substructure skid 220 also includes four position locks 281, each extending between the upper skid portion 221 and the lower skid portion 223. These position locks 281 both support the upper skid portion 221 at a desired and easily adjustable height above the lower skid portion 223 and lock the upper skid 221 in position to prevent the upper skid portion 221 from lifting off of the lower skid portion 223. As shown in FIGS. 8 and 8*a*, each of the position locks 281 includes a replaceable threaded sleeve 283 that is secured to the upper skid portion 221 by a sleeve retainer 287 and a key 285. The key 285 prevents relative rotation between the threaded sleeve 283 and the upper skid portion 221.

Each of the position locks 281 also includes a respective load seat 289 which is replacebly mounted in position on the lower skid portion 223 in alignment with the associated threaded sleeve 283. A lock tube 291 is threadedly engaged with the threaded sleeve 283 so as to bear at its lowermost end against the load seat 289. A threaded shaft 293 passes through the lock tube 291 and defines at its lower end a enlarged head 295 which bears against the underside of the load seat 289. The head 295 of the threaded shaft 293 is prevented from rotating with respect to the lower skid portion 223 by a lug 297 which is welded to the lower skid portion 223. A lock nut 299 is threadedly engaged with the top of the threaded shaft 293 so as to bear against the top of the lock tube 291. The lock nut 299 and the lock tube 291 are both provided with openings adapted to receive locating pins of suitable wrenches.

When the position lock 281 is fully tightened as shown in FIG. 8, the lower end of the lock tube 291 bears against the upper surface of the load seat 289 to support the upper skid portion 221 at a readily adjustable height above the lower skid portion 223. The threaded shaft 293 is placed in tension with the head 295 and the lock nut 299 tightened against the underside of the load seat 289 and the upper end of the lock tube 291, respectively. In this way, the threaded shaft 293 prevents the upper skid portion 291 from lifting away from the lower skid portion 293.

The embodiment 200 provides all of the advantages described above in conjunction with the first preferred embodiment. In addition, the leveling function provided by the substructure skid 220 further facilitates set up of the drilling machine.

In order to set up the drilling machine 200, the drilling site is first approximately leveled. Precise leveling is not required, as will be apparent from the following discussion. Once the drilling site has been approximately leveled, the substructure skid 220 is located in place, while in the collapsed position shown in FIG. 7. The position locks 281 are then released so as not to interfere with relative movement between the upper and lower skid portions 221 and 223. Pressurized hydraulic fluid is then directed to respective ones of the cylinders 263 to cause the leveling rams 251 to level the upper skid portion 221 without altering the position of the lower skid portion 223. Of course, the nuts 255 must be positioned appropriately so as not to interfere with movement of the pistons 261. Once the upper skid portion 221 has been leveled properly, the nuts 255 of the leveling rams 251 are then lowered into contact with the load bearing elements 257. In this way, the upper skid portion 221 is mechanically locked into position with respect to the lower skid portion 223, and any subsequent leakage of hydraulic fluid out of the cylinder 263 does not alter the position of the upper skid portion 221. This completes the adjustment of the leveling rams 251.

The position locks 281 are then adjusted so as to support the ends of the upper skid portion 221 properly and to prevent the upper skid portion 221 from lifting off of the lower skid portion 223. This is accomplished by first lowering the lock tubes 221 until they engage the upper surface of the load seats 289 and then tightening the lock nuts 299 until they engage the upper surfaces of the lock tubes 291.

At this point, the upper skid portion 221 has been leveled and the platform 233 can be raised as described above. The pipe boom skid 310 is then positioned on the upper skid portion 221 by means of the winch and the tie bolts 247 are used to secure the pipe boom skid 310 securely in position. Because the pipe boom skid 310 is supported by the previously leveled upper skid portion 221, there is no need to level the pipe boom skid 310 in an independent operation.

At this point, the mast is raised and the draw works skid 330 is positioned on the upper skid portion 221 as described above. Once again, because the upper skid portion 221 has already been leveled, the draw works skid 330 need only be positioned at a predetermined location on the upper skid portion 221, and no separate leveling operation is required.

Derigging of the second preferred embodiment 200 is substantially the reverse of the operation described above. After the draw works skid 330 has been removed, the mast has been lowered and removed, and the boom skid 310 has been removed, the nuts 255 and the lock tubes 291 are retracted and hydraulic fluid is released from the cylinders 263 so as to lower the upper skid portion 221 onto the lower skid portion 223. The lock nuts 299 are then secured so as to prevent further relative movement between the two skid portions 221 and 223.

From this description, it should be apparent that the substructure skid 220 simplifies the set up procedure significantly and that the lower skid portion 223 does not have to be leveled accurately. Rather, it is only the upper skid portion 221 which must be leveled accurately, and this can be done quickly and efficiently by means of the disclosed leveling rams 251 and position locks 281. Once the upper skid portion 221 has been leveled, it supports all components of the drilling machine, and thus excellent alignment is obtained merely by positioning the various components at predetermined positions on the upper skid portion 221.

Of course, it should be understood that a wide range of changes and modifications can be made to the preferred embodiments described above. For example, various types of pipe booms, boom clamps, and boom linkages can be substituted for those described above. It is therefore intended that the foregoing detailed description be regarded as illustrative rather than limiting, and that it be understood that it is the following claims, including all equivalents, which are intended to define the scope of this invention.

I claim:

1. A method for assembling an earth drilling machine comprising the following steps:

(a) providing a modular earth drilling machine comprising a drilling substructure skid, a draw works skid, and a pipe boom skid, said drilling structure skid comprising a collapsible drilling substructure platform and means for receiving the draw works skid and the pipe boom skid, said draw works skid comprising a draw works winch, and said pipe boom skid comprising:

a pipe boom pivotably mounted to the pipe boom skid for rotation about a pivot axis;

at least one hydraulic cylinder coupled between the pipe boom and the pipe boom skid to rotate the pipe boom about the pivot axis;

a hydraulic pump mounted to the pipe boom skid and coupled to the hydraulic cylinder by a closed hydraulic fluid circuit; and a pipe boom skid winch;

said pipe boom skid, pipe boom, hydraulic cylinder and hydraulic pump forming a modular unit which is transportable as a single unit without any disconnection of the closed hydraulic fluid circuit;

(b) positioning the substructure skid at a desired drilling position;

(c) utilizing the pipe boom skid winch to pull the pipe boom skid into position with respect to the substructure skid;

(d) utilizing the pipe boom skid winch to pull the draw works skid into position with respect to the substructure skid

2. The method of claim 1 further comprising the following step:

raising the collapsible drilling structure platform, including utilizing the pipe boom skid winch to lift the drilling structure platform during at least an initial stage of the raising step.

* * * * *